United States Patent [19]

Baldwin et al.

[11] 4,406,663

[45] Sep. 27, 1983

[54] PROCESS FOR CONCENTRATION OF SLURRIES COMPRISING INSOLUBLE COAL PRODUCTS

[75] Inventors: Roger A. Baldwin, Warr Acres; John E. Halko, Okarche; Ron S. Henke, Oklahoma City, all of Okla.

[73] Assignee: Kerr-McGee Corporation, Oklahoma City, Okla.

[21] Appl. No.: 241,935

[22] Filed: Mar. 9, 1981

[51] Int. Cl.[3] ..... C10L 1/32

[52] U.S. Cl. ..... 44/51; 44/1 A; 44/1 R; 406/197; 208/177; 208/8 LE

[58] Field of Search ..... 44/51, 1 A, 1 R; 208/8 LE, 177; 406/197

[56] References Cited

U.S. PATENT DOCUMENTS

| | | | |
|---|---|---|---|
| 4,162,958 | 7/1979 | Baldwin | 208/8 LE |
| 4,282,006 | 8/1981 | Funk | 44/51 |
| 4,304,572 | 12/1981 | Wiese et al. | 44/51 |

*Primary Examiner*—Jacqueline V. Howard
*Attorney, Agent, or Firm*—William G. Addison

[57] ABSTRACT

A process for producing a flowable concentrated aqueous slurry of insoluble coal products from a dilute slurry of insoluble coal products. The dilute slurry is concentrated to form a nonflowable concentrate having a solids level in excess of 65 weight percent. The nonflowable concentrate is introduced into a mixing zone together with an alkaline agent, surfactant and diluent wherein they are admixed to form a flowable concentrated aqueous slurry having a solids level in excess of 60 weight percent. Sufficient alkaline agent is present to provide a pH level of the slurry above about 9.0. The surfactant comprises at least about 0.01 percent by weight of the solids present. The diluent can comprise any suitable aqueous stream that does not adversely react with the insoluble coal products, alkaline agent or surfactant. The concentrated aqueous slurry is easily flowable from the mixing zone.

21 Claims, No Drawings

PROCESS FOR CONCENTRATION OF SLURRIES COMPRISING INSOLUBLE COAL PRODUCTS

CROSS-REFERENCE TO RELATED APPLICATION

Aspects of the present invention are related to subject matter disclosed in a copending application entitled "Process For Recovering Deashing Solvent From Insoluble Coal Products", Ser. No. 152,422 filed on May 22, 1980.

BACKGROUND OF THE INVENTION

1. Field of the Invention

This invention relates to a process for concentrating dilute slurries of insoluble coal products to form slurries suitable for use as, for example, feed to a gasifier.

2. Brief Description of the Prior Art

Various coal deashing processes have been developed wherein coal has been treated with one or more solvents to form coal liquefaction products comprising soluble coal products in association with the solvents and unconverted coal solids. The coal liquefaction products then are processed to separate the remaining solids, referred to as insoluble coal products, from the soluble coal products.

U.S. Pat. No. 3,607,716 and U.S. Pat. No. 3,607,717, assigned to the same assignee as the present invention, disclose processes wherein coal is contacted with at least one solvent and the resulting mixture then is separated in a separation zone into a heavy phase comprising insoluble coal products and solvent and a light phase comprising soluble coal products and solvent. In such processes, the light phase is withdrawn from the separation zone and passed to downstream fractionating vessels wherein the soluble coal products are separated into multiple fractions. The separated heavy phase has a viscosity under the conditions of operation whereby it is easily flowable for removal from the separation zone.

In U.S. Pat. Nos. 4,070,267, 4,070,268, 4,119,524, 4,162,956 and 4,164,466 processes are disclosed in which the heavy phase of insoluble coal products and solvent is withdrawn from a separation zone and flashed to recover the solvent from the insoluble coal products. The insoluble coal products then are recovered as substantially dry solids.

In U.S. patent application Ser. No. 152,422 filed May 22, 1980, a process is disclosed in which the solvent is recovered from the heavy phase in such a manner that an aqueous slurry of insoluble coal products is formed. In that process, the separated heavy phase is withdrawn from the separation zone at an elevated temperature and pressure and introduced into a mixing zone. A cooled slurry of make-up liquid and insoluble coal products then is introduced into the mixing zone in sufficient quantity to reduce the vapor pressure of the heavy phase and provide a diluted heavy phase slurry. The make-up liquid preferably comprises water.

The diluted heavy phase slurry is reduced in pressure and introduced into a treatment zone comprising at least one substantially slurry filled treatment vessel. The diluted heavy phase slurry is introduced into the lower portion of the vessel. The treatment vessel contains sufficient slurry to provide a hydrostatic pressure sufficient to prevent boiling of the diluted slurry upon introduction therein. The diluted slurry, having an average temperature above that of the slurry present in the treatment vessel, rises within the treatment vessel and the solvent flashes as the hydrostatic pressure is reduced. The flashing cools the temperature of the diluted slurry. The temperature level in the treatment vessel is maintained slightly above the azeotrope temperature to ensure solvent flashing. The temperature control is provided by the addition of steam, as necessary.

A portion of the cooled slurry of water and insoluble coal products is withdrawn from the treatment vessel and introduced into a thickener vessel. At least another portion of the slurry of water and insoluble coal products, either before or after withdrawal of the other portion from the treatment vessel, is recycled to the mixing zone.

In the thickener, the portion of cooled slurry is concentrated to a level in excess of 30 percent solids. Normally, the slurry will comprise 25 to 40 percent solids. The behavioral characteristics of the insoluble coal products have been found to limit the concentration of the solids in the slurry to levels generally below 60 percent. While methods other than gravity settling in a thickener are available, they are either cost prohibitive, such as evaporation, or as in the case with filtration, yield an undesirable nonflowable product.

It would be desirable to provide a means by which the slurry can be further concentrated while retaining flowability to provide a feed suitable for a gasifier.

SUMMARY OF THE INVENTION

The surprising discovery now has been made that dilute aqueous slurries comprising insoluble coal products can be concentrated to a solids level above 60 weight percent while retaining slurry flowability.

In one embodiment, the dilute slurry is fed to a filter that produces a nonflowable filter cake of at least 65 weight percent solids. The moist filter cake is added to a mixing zone together with a surfactant, alkaline agent and diluent, if needed. The diluent can comprise any aqueous solution, such as for example, a portion of the dilute aqueous slurry. Sufficient surfactant and alkaline agent are added to the mixing zone to produce a slurry of at least 60 weight percent solids. The concentrated slurry thus produced is flowable and can be used as feed to a gasifier.

In an alternate embodiment, particulate coal can be admixed with the filter cake to increase the yield of hydrogen that can be produced by use of the slurry as a gasifier feed.

In another embodiment of the invention, the dilute slurry is introduced into a gravity settler, such as for example, a thickener to concentrate the slurry to a level in excess of 40 weight percent solids. This thickened slurry then is introduced into a mixing zone and admixed with a surfactant and alkaline agent. Particulate coal then is added to the mixing zone to form a concentrated slurry containing in excess of 60 percent solids. The concentrated slurry then can be used as feed to a gasifier.

In yet another embodiment of the invention, substantially dry insoluble coal products can be admixed with the filter cake, diluent, surfactant and alkaline agent to produce a slurry of at least 60 weight percent solids. Alternatively, substantial dry insoluble coal products and particulate coal can be admixed with the filter cake.

DESCRIPTION OF THE PREFERRED EMBODIMENT

The present invention provides processes for concentrating dilute slurries of insoluble coal products to form slurries having a solids content in excess of about 60 weight percent. The dilute slurries of insoluble coal products, that is slurries having a solids content below about 60 weight percent, can be formed from the products of any process that produces insoluble coal products either in particulate form or a form capable of crushing, grinding or otherwise treating to form a slurry by admixing with an aqueous stream. In general, the insoluble coal products are produced via a coal deashing process designed to separate soluble coal products produced by coal liquefaction from the remaining unconverted insoluble coal products. A particularly preferred feed stream is the aqueous slurry of insoluble coal products produced by the process of copending patent application Ser. No. 152,422 entitled "Process For Recovering Deashing Solvent From Insoluble Coal Products" filed May 22, 1980, the entire disclosure of which is incorporated herein by reference.

In a particular coal deashing process, coal liquefaction products resulting from the hydroconversion of coal are contacted with one or more solvents under conditions of elevated temperature and pressure effective to separate the coal liquefaction products into at least two phases. More particularly, the coal liquefaction products and solvent are introduced into a separation zone in which they are caused under conditions of high temperature and pressure, to separate into a light phase comprising soluble coal products in admixture with some solvent and a heavy phase comprising insoluble coal products in admixture with some solvent. The high temperature and pressure heavy phase then is withdrawn from the separation zone and introduced into a mixing zone. A cooled slurry of make-up liquid such as water and insoluble coal products then is introduced into the mixing zone in sufficient quantity to reduce the vapor pressure of the heavy phase and provide a diluted heavy phase slurry.

The diluted heavy phase slurry is reduced in pressure and introduced into a treatment zone comprising at least one substantially slurry filled treatment vessel. The diluted heavy phase slurry is introduced into the lower portion of the vessel. The treatment vessel contains sufficient slurry to provide a hydrostatic pressure sufficient to prevent boiling of the diluted slurry upon introduction therein. The diluted slurry, having an average temperature above that of the slurry present in the treatment vessel, rises within the treatment vessel and the solvent flashes as the hydrostatic pressure is reduced. The flashing cools the temperature of the diluted slurry. The temperature level in the treatment vessel is maintained slightly above the azeotrope temperature to ensure solvent flashing. The temperature control is provided by the addition of steam, as necessary.

The separated solvent and steam are withdrawn from the first treatment vessel and condensed. The condensed solvent is separated from the water and recycled in the process.

A portion of the cooled slurry of water and insoluble coal products is withdrawn from the treatment vessel as a product. The product slurry has a solids content below 60 weight percent. At least another portion of the slurry of water and insoluble coal products, either before or after withdrawal of the other portion from the treatment vessel, is recycled to the mixing zone.

In one embodiment, the dilute slurry, having a solids content below 60 weight percent, is fed to a filter or other suitable apparatus to produce a nonflowable filter cake or concentrate of at least 65 weight percent solids. The apparatus can comprise any of the various types that are commercially available which are known by those skilled in the art to be capable of producing such a concentrate from an aqueous slurry. A predetermined quantity of the nonflowable concentrate then is introduced into a mixing zone together with a quantity of a surfactant, alkaline agent and diluent to produce a slurry of at least about 60 weight percent solids.

Preferably, the alkaline agent and a portion of the diluent are introduced into the mixing zone prior to introduction of the nonflowable concentrate. The nonflowable concentrate of insoluble coal products then is introduced at a rate that yields a flowable slurry of the insoluble coal products. Additional quantities of the diluent and small quantities of the surfactant are added to the mixing zone as required to maintain a flowable slurry of the insoluble coal products.

The alkaline agent is employed to adjust the pH of the slurry in the mixing zone to a level above about 9.0. Preferably the pH is adjusted to a level above about 10.0 and most preferably above about 12.0 The alkaline agent can comprise any suitable alkaline compound such as for example, sodium, potassium or ammonium hydroxides, calcium oxide or the like. The alkaline agent can be introduced into the mixing zone in solid form or dissolved in a suitable carrier fluid, such as a portion of the diluent, prior to introduction into the mixing zone.

The diluent employed in the production of the aqueous slurries of the present invention can comprise fresh water, process derived aqueous streams from, for example, a coal liquefaction process which contains contaminants, such as, phenolic compounds, cresols, ammonium compounds or the like or any other contaminated aqueous stream in which the contaminants that are present do not adversely react with the solids which are to be slurried, the alkaline agent or surfactant to prevent the formation of the aqueous slurry. Such streams often are of an alkaline nature and therefore can be employed to provide a portion of or all of the required alkaline agent in the aqueous slurry of the present invention.

The quantity of surfactant added is dependent upon the percentage of solids in the product slurry. However, the addition range of the surfactant normally should be in the range of from about 0.01 to about 1.0 percent by weight of the solids present in the slurry and preferably, 0.01 to 0.5 percent by weight.

The surfactant preferably comprises at least one compound having a straight or branched long chain hydrocarbon group, an aromatic group or an heteroatom-containing group and an anionic, nonionic or cationic group. The anionic group is one selected from the group consisting of a carboxylic acid salt group, a sulfonate salt group, a sulfate group or a phosphate group. The nonionic group is one selected from the group consisting of ethers, hydroxyls, esters and amides. The cationic group is one selected from the group consisting of amines and quaternary ammonium salts. A particular anionic surfactant which has been found suitable for forming the aqueous slurry of the present invention is a polyfunctional compound identified as "Polywet Oligomeric Surfactant" and is available commercially from Uniroyal Chemical, Naugatuck, Conn., such surfactant being designated as "POLYWET® KX-3," for example. Another anionic surfactant which has been found to be suitable for producing the aqueous slurry of the present invention is identified as "LOMAR PW" and is available commercially from Diamond Shamrock Corporation, Morristown, N.J., for example.

The concentrated slurry thus produced can be used as a feed to a gasifier to produce hydrogen for use, for example, in a coal liquefaction process. It is interesting to note that a concentrated flowable slurry of insoluble coal products cannot be formed by gravity settling such as occurs in a thickener or by other known methods of concentrating slurries. When an attempt is made to produce a slurry having a solids content in excess of 60 weight percent within a thickener, the resultant slurry substantially is nonflowable from the thickener.

In an alternate embodiment of the invention, particulate coal can be admixed with the nonflowable concentrate in the mixing zone. Such a mixture increases the yield of hydrogen or synthesis gas that can be produced from the slurry in a gasifier. Preferably, to facilitate use of the slurry as a feed to a gasifier, the raw coal is ground to a particle size such that at least about 75 percent thereof will pass through a 200 mesh U.S. Standard Sieve. The particulate coal can be introduced either before or after addition of the nonflowable concentrate or simultaneously therewith. Preferably, the alkaline agent is added to the diluent within the mixing zone prior to introduction of the surfactant, nonflowable concentrate or particulate coal. The slurry resulting from such admixing contains in excess of 60 weight percent solids and is pumpable and flowable.

In yet another embodiment of the present invention, the dilute slurry is introduced into a gravity settler or thickener to concentrate the slurry to a level in the range of from about 25 to below about 40 weight percent solids. This thickened slurry then is introduced into a mixing zone for admixing with a quantity of particulate coal, a surfactant and alkaline agent. Preferably, the alkaline agent is introduced in a quantity sufficient to provide a pH level above about 9.0 for the slurry and most preferably above about 12.0. The particulate coal then is added to the slurry within the mixing zone together with small quantities of the surfactant to facilitate wetting of the surface of the particulate coal. The surfactant should be present in an amount of from about 0.01 to about 1.0 percent and preferably from about 0.01 to about 0.5 percent by weight of the solids in the slurry. The concentrated slurry thus formed contains in excess of about 60 weight percent and normally in excess of 65 weight percent solids.

Surprisingly, it has been found that the quantity of surfactant necessary to form a flowable slurry of the particulate coal is less than the amount necessary to slurry a corresponding amount of nonflowable concentrate comprising insoluble coal products.

In still yet another embodiment of the invention, substantially dry insoluble coal products (non-wetted in comparison to the moisture-containing nonflowable concentrate) can be admixed with the nonflowable concentrate comprising insoluble coal products or thickened slurry of the preceeding embodiments instead of or in admixture with particulate coal to form a flowable slurry that contains in excess of 60 percent solids.

The present invention minimizes the quantity of surfactant necessary to effect formation of the slurry. The addition of the alkaline agent to the mixing zone prior to addition of the surfactant significantly reduces the quantity of surfactant necessary to facilitate wetting of the solids. Further, the composition of the alkaline agent, that is the alkali metal or alkaline earth constituent, does not appear to substantially affect the viscosity of the slurry of insoluble coal products.

In contrast to numerous known processes for producing an aqueous slurry of particulate coal, no hydrocarbon liquids or other substantially immiscible liquids are necessary to produce the slurry of the insoluble coal products of this invention. Further, the present invention provides methods of producing a slurry containing a substantially higher solids content than other known processes.

To further illustrate the present invention, and not by way of limitation, the following example is provided.

EXAMPLE

In a first test, a quantity of an aqueous slurry comprising 5–20 weight percent insoluble coal products is introduced into a concentrator wherein it is concentrated to a level greater than 55 weight percent solids. The concentrated insoluble coal products are nonflowable. A quantity of an alkaline agent comprising sodium hydroxide and a surfactant comprising "LOMAR PW" (available commercially from Diamond Shamrock Corporation; 87 weight percent active ingredients) are added to the concentrated insoluble coal products in the concentrator. The concentrate still is nonflowable after addition of the alkaline agent and surfactant.

A second quantity of the aqueous slurry then is filtered on a vacuum filter to form a moist filter cake. An alkaline agent comprising sodium hydroxide is dissolved in water and introduced into a stirred mixer. Incremental portions of the filter cake are added to the water in the mixer at a rate which yields a flowable slurry. Sufficient filter cake is added to produce a slurry of about 65 weight percent solids. Additional quantities of the alkaline agent are added as necessary to maintain the pH level of the slurry that is formed above about 11.0. After 60 percent of the total quantity of solids is added to the mixer, small quantities of a surfactant comprising LOMAR PW are added to the mixer. The total quantity of surfactant added is about 0.25 percent of the weight of the solids. The slurry thus formed is flowable from the mixing zone.

A third quantity of the aqueous slurry is filtered on the vacuum filter to form a moist filter cake. An alkaline agent comprising sodium hydroxide is dissolved in water and introduced into the stirred mixer. The pH level of the water is about 12.0. Incremental portions of the filter cake and particulate coal having a 200 mesh or smaller particle size then are added in equal quantities to the mixer. Sufficient solids are added to produce a slurry of about 65 weight percent solids. A quantity of surfactant comprising LOMAR PW is added to the mixer after about 60 percent of the total solids are introduced therein. The total quantity of surfactant added is about 0.15 percent of the weight of the solids. The slurry thus formed is flowable from the mixer.

A fourth quantity of the aqueous slurry is filtered on the vacuum filter to form a moist filter cake. An alkaline agent comprising sodium hydroxide is dissolved in water and introduced into the stirred mixer. The pH level of the water is about 10.5. Incremental portions of the filter cake and an admixture of substantially dry insoluble coal products and particulate coal having a 200 mesh or smaller particle size then are added in equal quantities to the mixer. The admixture is 45 weight percent substantially dry insoluble coal products and 55 weight percent particulate coal. Sufficient solids are added to produce a slurry of about 63 weight percent solids. A quantity of surfactant comprising LOMAR PW is added to the mixer after about 60 percent of the solids are introduced therein. The total quantity of surfactant added is about 0.25 percent of the weight of the solids. The slurry thus formed is flowable from the mixer.

The results clearly illustrate the benefits which are derived through the use of the present invention to produce concentrated aqueous slurries of insoluble coal products.

There is a maximum solids level with respect to the formation of the concentrated aqueous slurry of the present invention and the exact solids level is believed to be dependent upon the pH level of the slurry and the particular surfactant used. Although the precise maximum solids level is not known, it is believed that the maximum solids level is about 80 weight percent.

While the present invention has been described with respect to what at present are considered to be the preferred embodiments, it is to be understood that changes, substitutions modifications and the like can be made in the processes without departing from the spirit or scope of the invention as defined in the appended claims.

What is claimed is:

1. A process for producing a flowable concentrated aqueous slurry comprising insoluble coal products from a dilute aqueous slurry consisting of water and insoluble coal products which comprise:

providing a dilute aqueous slurry consisting of water and insoluble coal products, said dilute slurry having a solids level below about 60 weight percent;

concentrating said aqueous slurry to form a nonflowable concentrate having a solids level in excess of 65 weight percent;

admixing an alkaline agent and a diluent to form a first mixture, said alkaline agent being present in sufficient quantity to provide a pH level of said first mixture of above about 9.0;

admixing a predetermined amount of said nonflowable concentrate with said first mixture to form a second mixture;

admixing a predetermined amount of a surfactant with said second mixture to form a third mixture, said surfactant comprising at least about 0.01 percent by weight of the total solids; and admixing an additional amount of said nonflowable concentrate with said third mixture to form a flowable concentrated aqueous slurry containing in excess of about 60 weight percent solids.

2. The process of claim 1 wherein the alkaline agent is present in sufficient quantity to provide a pH level of said first mixture above about 10.0.

3. The process of claim 1 wherein the alklaine agent is present in sufficient quantity to provide a pH level of said first mixture above about 12.0.

4. The process of claim 1 wherein said surfactant comprises from about 0.01 to about 1.0 percent by weight of the solids present in the flowable concentrated aqueous slurry.

5. The process of claim 1 wherein said surfactant comprises from about 0.01 to about 0.5 percent by weight of the solids present in the flowable concentrated aqueous slurry.

6. The process of claim 1 wherein the nonflowable concentrate comprises a concentrate produced by filtration or centrifugation of the dilute slurry.

7. The process of claim 1 wherein said surfactant is defined further as comprised of at least one compound having a straight or branched long chain hydrocarbon group, an aromatic group or an heteroatom-containing group and an anionic, cationic or nonionic group.

8. A process for producing a flowable concentrated aqueous slurry containing insoluble coal products from a dilute slurry consisting of water and insoluble coal products which comprise:

providing a dilute aqueous slurry consisting of water and insoluble coal products, said dilute slurry having a solids level below about 60 weight percent;

concentrating said aqueous slurry to form a nonflowable concentrate having a solids level in excess of about 65 weight percent;

admixing an alkaline agent and a diluent to form a first mixture, said alkaline agent being present in sufficient quantity to provide a pH level of said first mixture above about 9.0;

admixing a predetermined amount of at least one solids member selected from the group consisting of particulate coal and nonflowable concentrate with said first mixture to form a second mixture;

admixing a predetermined amount of a surfactant with said second mixture to form a third mixture, said surfactant comprising at least about 0.01 percent by weight of the total solids; and admixing a predetermined amount of at least one solids member selected from the group consisting of particulate coal and nonflowable concentrate with said third mixture to form a flowable concentrated aqueous slurry containing in excess of about 60 weight percent solids, at least a portion of the solids admixed to form said concentrated aqueous slurry comprising nonflowable concentrate.

9. The process of claim 8 wherein the alkaline agent is present in sufficient quantity to provide a pH level of said first mixture above about 10.0.

10. The process of claim 8 wherein the alkaline agent is present in sufficient quantity to provide a pH level of said first mixture above about 12.0.

11. The process of claim 8 wherein said surfactant comprises from about 0.01 to about 1.0 percent by weight of the solids present in the flowable concentrated aqueous slurry.

12. The process of claim 8 wherein said surfactant comprises from about 0.01 to about 0.5 percent by weight of the solids present in the flowable concentrated aqueous slurry.

13. The process of claim 8 wherein the nonflowable concentrate comprises a concentrate produced by filtration or centrifugation of the dilute slurry.

14. The process of claim 8 wherein said surfactant is defined further as comprised of at least one compound having a straight or branched chain hydrocarbon group an aromatic group or an heteroatom-containing group and an anionic, cationic or nonionic group.

15. The process of claim 8 wherein said diluent comprises at least a portion of said dilute aqueous slurry consisting of water and insoluble coal products.

16. A process for producing a flowable concentrated aqueous slurry containing insoluble coal products from a dilute slurry consisting of water and insoluble coal products which comprises:

providing a dilute aqeuous slurry consisting of water and insoluble coal products, said dilute slurry having a solids level below about 60 weight percent;

concentrating said dilute aqueous slurry to form a nonflowable concentrate having a solids level in excess of about 60 weight percent;

admixing an akaline agent and a diluent to form a first mixture, said alkaline agent being present in sufficient quantity to provide a pH level of said first mixture of above about 9.0;

admixing a predetermined amount of at least one solids member selected from the group consisting of particulate coal, nonflowable concentrate and substantially dry insoluble coal products with said first mixture to form a second mixture;

admixing a predetermined amount of a surfactant with said second mixture to form a third mixture. said surfactant being present in an amount of at least about 0.01 percent by weight of the total solids; and admixing a predetermined amount of at least one solids member selected from the group consisting of particulate coal, nonflowable concentrate and substantially dry insoluble coal products with said third mixture to form a flowable concentrated aqueous slurry containing in excess of about 60 weight percent solids, at least a portion of the solids admixed to form said concentrated aqueous slurry comprising nonflowable concentrate.

17. The process of claim 16 wherein the alkaline agent is present in sufficient quantity to provide a pH level of said first mixture above about 10.0.

18. The process of claim 16 wherein the alkaline agent is present in sufficient quantity to provide a pH level of said first mixture above about 12.0.

19. The process of claim 16 wherein said surfactant comprises from about 0.01 to about 1.0 percent by weight of the solids present in the flowable concentrated aqueous slurry.

20. The process of claim 16 wherein said surfactant is defined further as comprised of at least one compound having a straight or branched long chain hydrocarbon group, an aromatic group or an heteroatom-containing group and an anionic, cationic or nonionic group.

21. The process of claim 16 wherein said diluent comprises at least one member selected from the group consisting of water and a dilute aqueous slurry consisting of water and insoluble coal products.

* * * * *